US005347661A

United States Patent [19]

Fly et al.

[11] Patent Number: 5,347,661

[45] Date of Patent: Sep. 20, 1994

[54] WATER CONDITIONER DISPENSING APPARATUS

[76] Inventors: Howard G. Fly; Robert G. Cook, both of Box 63, Ovando, Mont. 59854

[21] Appl. No.: 86,234

[22] Filed: Jul. 1, 1993

[51] Int. Cl.[5] ..... E03D 9/02

[52] U.S. Cl. ..... 4/225.1; 4/227.5; 4/226.1; 222/187

[58] Field of Search ..... 4/225.1, 226.1, 227.1, 4/227.5, 228, 222, 223, 224, 231; 222/187

[56] References Cited

U.S. PATENT DOCUMENTS

| | | | |
|---|---|---|---|
| 2,045,473 | 6/1936 | Keillor | 4/225.1 |
| 2,424,174 | 7/1947 | Jensen et al. | 4/225.1 |
| 2,515,569 | 7/1950 | Pozen | 4/225.1 |
| 2,520,056 | 8/1950 | Pozen | 4/225.1 |
| 2,697,841 | 12/1954 | Collins | 4/228 |
| 2,761,151 | 9/1956 | Ferrando | 4/225 |
| 2,770,492 | 11/1956 | Kuss | 222/187 |
| 3,105,245 | 10/1963 | Finkbinek | 4/225.1 |
| 3,112,499 | 12/1963 | Thornton | 4/222 |
| 3,228,040 | 1/1966 | Currie | 4/226 |
| 3,290,698 | 12/1966 | Joyner et al. | 4/228 |
| 3,482,269 | 12/1969 | Tietema et al. | 4/226.1 |
| 3,623,167 | 11/1971 | Syrenne et al. | 4/225 |
| 4,429,423 | 2/1984 | Syrenne | 4/225.1 |
| 4,467,480 | 8/1984 | Keller | 4/225 |
| 5,042,095 | 8/1991 | Shoepe et al. | 4/225 |

FOREIGN PATENT DOCUMENTS

| | | | |
|---|---|---|---|
| 0156921 | 1/1921 | United Kingdom | 4/226.1 |

*Primary Examiner*—Henry J. Recla
*Assistant Examiner*—Greg Vidovich
*Attorney, Agent, or Firm*—Wells, St. John, Roberts, Gregory & Matkin

[57] ABSTRACT

A preferred embodiment of a water conditioner dispensing apparatus is disclosed for use with a toilet having a bowl, a bowl supply pipe, and a filler tube which emits a jet of bowl makeup water into the bowl supply pipe to refill the bowl after flushing. The apparatus has a conditioner container with a reservoir for holding liquid conditioner. A wick extends from the container reservoir for placement in a jet of bowl makeup water so that liquid conditioner is dispensed through the bowl supply pipe into the toilet bowl to selectively treat only the bowl water and not the flush water stored in the tank.

21 Claims, 4 Drawing Sheets

WATER CONDITIONER DISPENSING APPARATUS

TECHNICAL FIELD

This invention relates to water conditioning apparatus for use with sanitary fixtures.

BACKGROUND OF THE INVENTION

Achieving sanitation in the disposal of human waste has been of concern for centuries. Water-flushed latrines have been discovered which date back as far as 2500 B.C., and Rome is known to have had some sort of flush latrine system in the fourth century A.D. However, these devices typically consumed great quantities of fresh water to accomplish their task.

Despite the presence of these early systems, efficient human waste disposal was accomplished only fairly recently. It was not until the late 1800s that Britain invested in sewer systems. Even at that time, such systems relied on a constant supply of water to dilute and remove sewage. Water closets or toilets as we know them today were not developed until nearly the twentieth century, when cistern-type flush toilets became available in some areas. Since that time, numerous improvements have been made, resulting in the modern flush toilets which we now take for granted.

One early inventor of a flush toilet recommended that it be flushed perhaps once or twice each day. In contrast, today's germ-conscious society generally insists that a toilet be flushed after every use. Furthermore, an effort to reduce germs and odors, various water conditioners are frequently placed in toilets, such as disinfectants, deodorizers, and other chemicals or solutions. There are a number of devices for operation with flush toilets to dispense these conditioners into toilet water. The general purpose of these devices is to mix conditioner with the water which remains in the toilet bowl after flushing.

One of the primary disadvantages of prior art toilet conditioner devices relates to their need for frequent replacement. Many people consider the performance of any toilet-related maintenance to be extremely unpleasant. Thus, even though replacement of the prior art devices might be considered simple and convenient in any other context, it becomes an unpleasant task when associated with a toilet. This is particularly true of devices which are located within the toilet bowl itself. However, many people also dislike having to remove the cover of the toilet's flush tank to replace tank-positioned dispensers. Furthermore, some such dispensers are positioned on the bottom of the flush tank, requiring a person to reach to the bottom of the tank through a foot or more of water.

A related problem with prior art toilet conditioner devices is that they are not easily recyclable or reusable. Most such devices are disposable, resulting in a waste of plastic components, not to mention the associated cost of replacing such components. In addition, consumers are beginning to prefer goods which do not have harmful environmental effects such those produced by disposable plastic devices.

A further disadvantage of many prior art conditioner devices is that much of the dispensed chemical is wasted. This is particularly true of devices which are simply placed within a toilet's flush tank. Most of the water entering the flush tank is consumed during flushing, and does not remain in the toilet bowl after flushing. Thus, the most significant portion of any water conditioner dispensed in the flush tank is rapidly flushed down the toilet drain, providing little or no benefits. In addition, such wasted water conditioner may in some cases have a detrimental environmental impact. Generally, it is desirable to limit the amount of chemical water conditioner used to provide the desired deodorant, coloring, germicidal or other associated benefits.

It is furthermore desirable to limit or at least regulate the actual amount of conditioner dispersed during or between each flush in order to thereby limit replacement expenses and to reduce the sometimes harmful environmental effects associated with chemicals in waste waters. However, many prior art devices are unable to meter the amount of conditioner placed within the surrounding water. For instance, soluble bars will continue to dissolve while they are surrounded by water. Thus, the amount of dispersed conditioner for each flush is dependent on the time between flushes. Some liquid conditioner dispensers suffer from this same problem. Furthermore, the rate of conditioner dispersal is not constant in many devices, tending to either increase or decrease with the life of the devices. These shortcomings result in an inefficient use of water conditioner.

Some prior art dispensing devices disperse conditioner into the overflow pipe of a toilet flush tank. A toilet's overflow pipe communicates bowl makeup water directly to the toilet bowl to refill the toilet bowl after flushing. Accordingly, most of the water passing through the overflow pipe remains in the toilet bowl after flushing. Conditioner dispersed in the bowl makeup water likewise ends up in the toilet bowl rather than being swept primarily down the toilet drain with flush water.

One type of conditioner dispenser used in conjunction with a toilet overflow pipe utilizes a solid or granular conditioner. Water entering the toilet overflow pipe passes through or over the conditioner, thus dissolving a portion of the conditioner and carrying it into the toilet bowl. An example of this type of device is described in U.S. Pat. No. No. 2,697,841.

Some disadvantages of using a solid or granular conditioner are mentioned above. Another disadvantage is that dissolvable solid materials are much more difficult to formulate than liquid conditioners. Generally, dissolvable solid conditioners are more expensive than liquid conditioners. Furthermore, they are available in only a limited number of formulations as compared to liquid formulas.

The prior art devices which place granular or solid conditioners within an overflow pipe are also somewhat difficult to install, replace or refill. In addition, they often interfere with the free flow of water through the overflow pipe. If such interference is severe enough, it prevents complete filling of the toilet bowl.

Another type of conditioner dispersing device used with an overflow pipe dispenses liquid conditioner into the overflow pipe during every flush cycle. U.S. Pat. No. No. 2,761,151 shows this type of device. Devices for dispensing liquid conditioner into the toilet overflow pipe are often complex. Such devices typically include valves, springs, and other moving parts which are prone to failure or improper operation. The complexity of the devices also increases their cost. Such devices are furthermore difficult to install and replace, decreasing their usefulness to the typical person.

Because of the various inadequacies of the prior art, discussed above, many people simply choose not to use the prior art devices. The invention described below addresses the inadequacies of the prior art, providing a conditioner dispensing apparatus which is uniquely efficient, convenient, and inexpensive. The advantages of the invention are presented in more detail in the discussion which follows.

BRIEF DESCRIPTION OF THE DRAWINGS

One or more preferred forms of the invention are described herein with reference to the accompanying drawings. The drawings are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
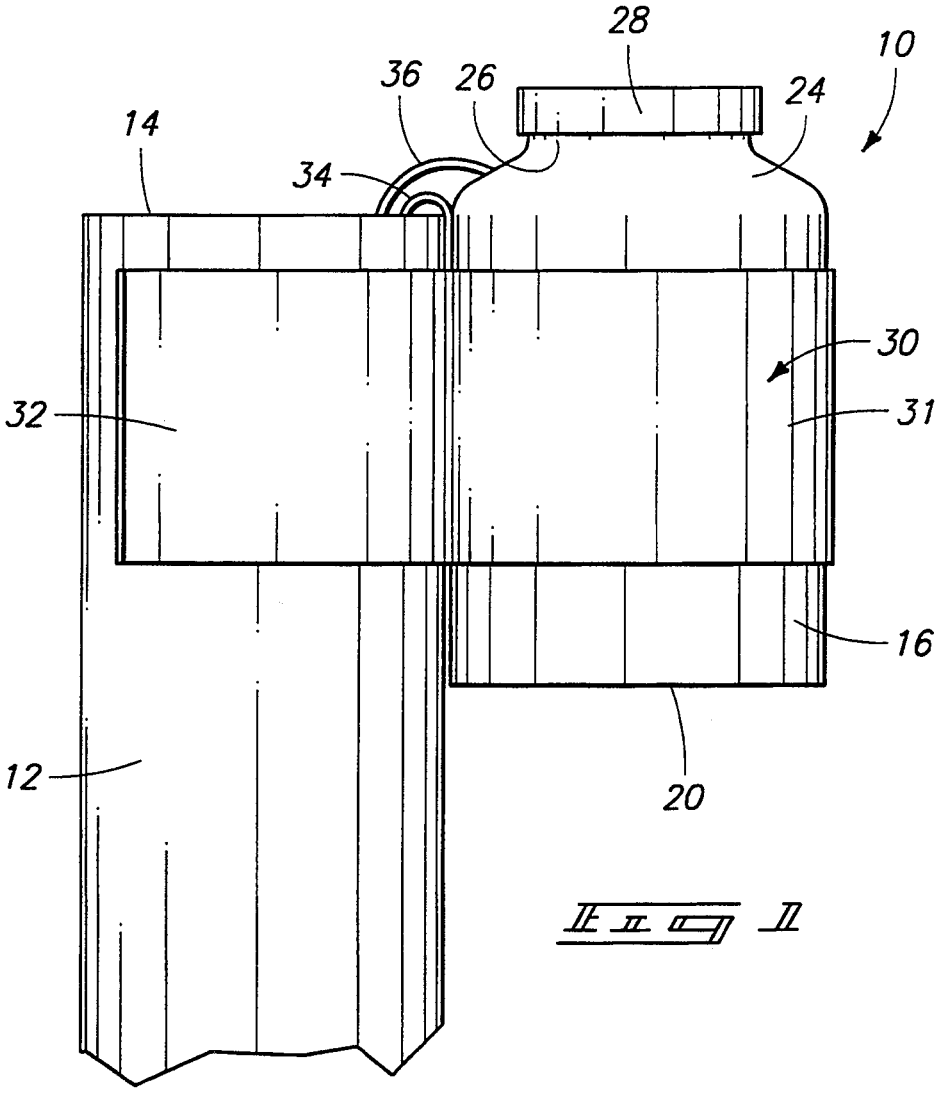
FIG. 1 is a front view of a water conditioner dispensing apparatus in accordance with a preferred embodiment of the invention. The water conditioner dispensing apparatus is shown mounted upon the overflow pipe of a toilet.
Figure 2:
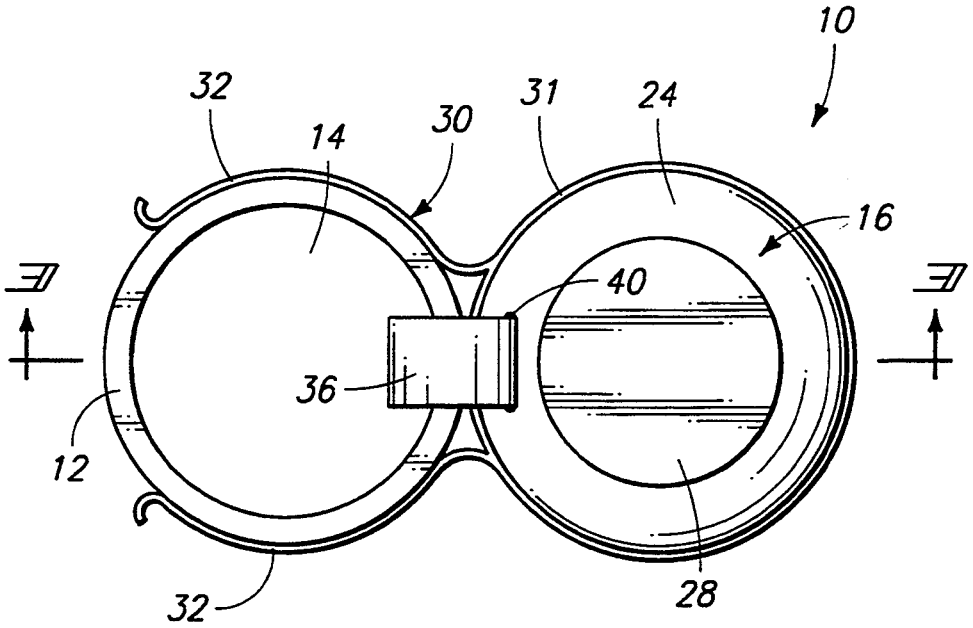
FIG. 2 is a top view of the water conditioner dispensing apparatus and overflow pipe is shown in FIG. 1.
Figure 3:
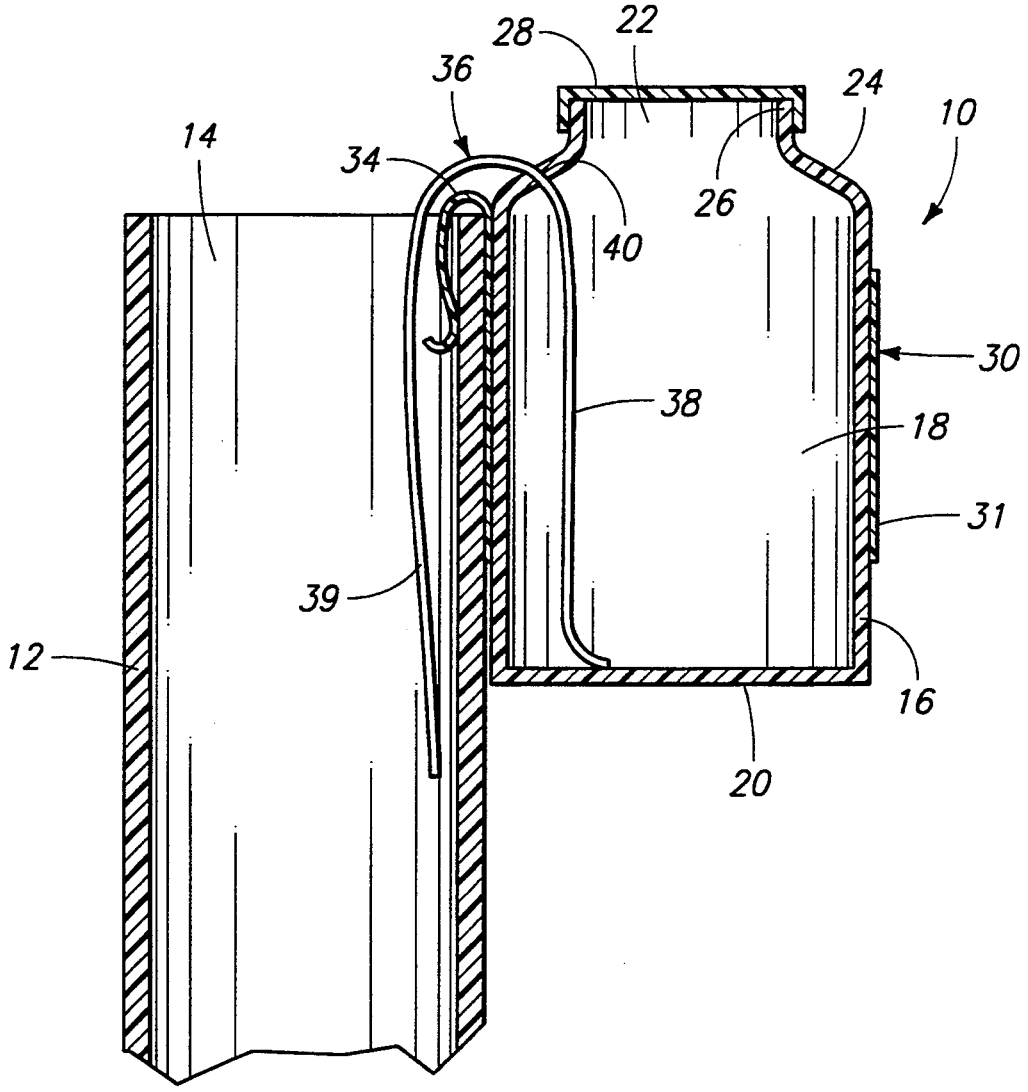
FIG. 3 is a sectional view of the water conditioner dispensing apparatus and overflow pipe of FIG. 1, taken along the line 3—3 of FIG. 2.

FIGS. 1–3 show a water conditioner dispensing apparatus for use with a flush toilet. The dispensing apparatus is generally designated by the reference numeral 10. It is adapted to be mounted on a toilet overflow pipe 12. Typically the toilet tank overflow pipe also serves as the bowl supply pipe which receives make-up water for filling the tank. Bowl supply pipe 12 has an open upper end 14. Dispensing apparatus 10 is preferably mounted or attached adjacent open upper end 14 of bowl supply pipe 12.

Water conditioner dispenser 10 generally comprises a closed conditioner container 16. Container 16 is preferably formed of a plastic or other suitable material not soluble in water or the conditioning chemical being used. Container 16 has an open interior, forming a liquid reservoir 18 therein (FIG. 3) for holding liquid conditioner. As shown, the container is generally cylindrical, having a closed bottom 20 and an open top 22. The container has an upper transition portion 24 through which the diameter of the container is gradually reduced to form a necked-down or reduced-diameter portion 26 at the upper end of container 16. The top opening 22 is formed in this necked-down portion. A removable container lid 28 is received over open top 22. Lid 28 is preferably detachably connected using a threaded connection, snap fit, or otherwise provided with other means for detachably securing it to container 16.

Dispensing apparatus 10 includes or is supplied with a desired liquid conditioner placed within container reservoir 18. The liquid conditioner comprises, for example, a disinfecting or deodorizing solution or a solution which performs both disinfecting and deodorizing. Colorizing dyes or other agents can also be included. Container reservoir 18 can be filled before retail sale, immediately prior to installation of apparatus 10, or anytime during use of apparatus 10 by simply removing lid 28 and pouring in an appropriate liquid conditioner. Container reservoir 18 can also be refilled after depletion of the contained conditioner.

Dispenser 10 preferably includes a support feature or dispenser mount for mounting the apparatus in a suitable location. This feature is preferably constructed to engage a toilet bowl supply pipe to support the dispenser thereon. In the embodiment shown, the support feature comprises a support clip 30 which engages the bowl supply pipe to removably attach the dispenser upon the bowl supply pipe, such as at the upper end thereof. Support clip 30 includes a ring-shaped container adapter portion 31 having a cylindrical interior surface which surrounds and engages container 16. Clip 30 includes a pair of laterally-opposed side arms 32 which extend laterally from container 16 to partially encircle and frictionally engage bowl supply pipe 12. Arms 32 are preferably semi-circular and formed of a resilient material such as plastic or light-weight spring steel. The arms are fabricated to apply inward force against bowl supply pipe 12 to firmly engage the bowl supply pipe. The arms are resiliently bendable outward to allow installation or removal of the apparatus.

Support clip 30 also advantageously includes a vertical support piece in the form of clip 34, or other hook, hanger, stop, or other suitable vertical support. Clip 34 is designed for hooking over upper end 14 of the bowl supply pipe. Clip 34 functions as a hook and provides additional support for dispenser 10. It extends upward from adapter portion 31 of support clip 30 and wraps or clips over the wall of bowl supply pipe 12 at its upper end 14. Hook 34 is preferably fabricated from the same resilient material as arms 32 to apply a compressive force against the wall of bowl supply pipe 12 to firmly retain dispenser 10 on bowl supply pipe 12 while still allowing installation and removal.

Water conditioner dispensing apparatus 10 further comprises a wick 36 which extends from container reservoir 18 into bowl supply pipe 12. Wick 36 in the preferred embodiment is a flat strip of highly absorbent material capable of wicking liquid out from reservoir 18 by capillary action. Wick 36 can be of braided, woven, felt or other materials. More specifically, wick 36 has an inner portion 38 and an outer portion 39. Inner portion 38 extends downward from upper transition 24 within container reservoir 18 and preferably rests against bottom 20 of container 16. Inner portion 38 is at least partially immersed in the liquid conditioner within the conditioner container. A wick aperture 40 is formed in upper transition portion 24 of container 16. Wick 36 extends from container reservoir 18 through the wick aperture 40. Outer portion 39 of wick 36 extends outside of conditioner container 16 and is draped over and within bowl supply pipe 12.

The various components of water conditioner dispensing apparatus 10 are fabricated in accordance with known techniques and materials, some of which are specifically noted above.

Figure 5:
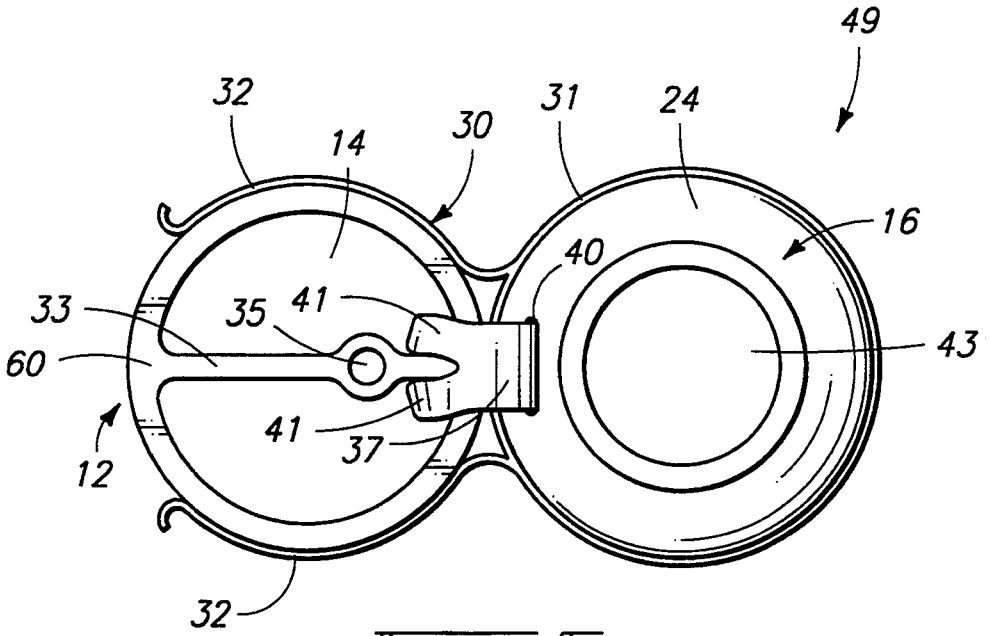
FIG. 5 is a top view of an alternative water conditioner dispensing apparatus and overflow pipe in accordance with another preferred embodiment of the invention.

FIG. 5 shows an alternative water conditioner dispensing apparatus 49 in accordance with a second preferred embodiment of the invention. The apparatus shown by FIG. 5 is similar in most respects to the apparatus already described with reference to FIGS. 1–3. Accordingly, the same reference numerals have been used to designate corresponding components of the two embodiments.

FIG. 5 shows the upper end of bowl supply pipe 12 fitted with an end piece 60. End piece 60 includes a horizontal cross-piece 33 which spans the upper end of bowl supply pipe 12. Cross-piece 33 forms a fill tube aperture 35 which leads into bowl supply pipe 12 from above. The fill tube aperture is utilized as a guide through which a bowl fill tube is positioned. As described below, the bowl fill tube emits a jet of bowl makeup water into bowl supply pipe 12.

Water conditioner dispensing apparatus 49 has a divided or forked wick 37 which is similar to wick 36 as described with reference to Figs. 1–3. However, wick 37 is longitudinally split along its outer portion, after it exits aperture 40. Wick 37 thus forms a pair of legs 41 which drape around opposite sides of cross-piece 33 and extend down therefrom into bowl supply pipe 12.

Another difference between apparatus 10 of Figs. 1–3 and apparatus 49 of FIG. 5 is that water conditioner dispensing apparatus 49 has no lid. Rather, it has an open top 43. Thus, instead of being capped, container 16 is upwardly open when placed within a toilet flush tank. This allows the fluid level within container 16 to be easily checked. It also reduces the effort required to refill the container. Fluid can be simply poured into container 16 of apparatus 49 without touching interior parts of the toilet.

Figure 4:
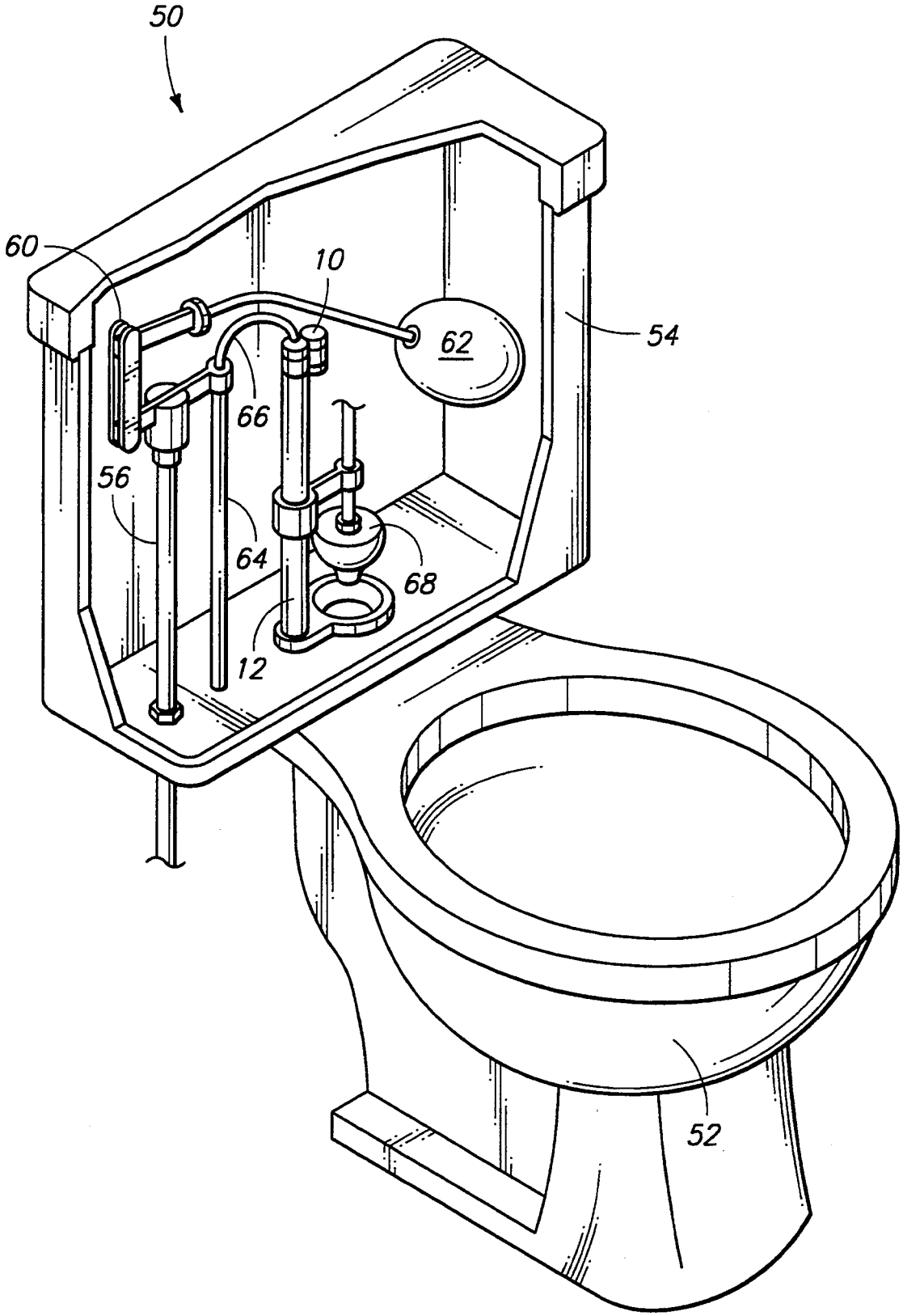
FIG. 4 is a perspective view of a toilet, with a portion of the toilet 's flush tank broken away and the water conditioner dispensing apparatus of FIG. 1 mounted adjacent the toilet 's overflow pipe.

Installation and the novel operational methods of water conditioner dispensing apparatuses 10 and 49 are now described with reference to FIG. 4, which shows the apparatus installed in a typical flush toilet 50. Toilet 50 includes a toilet bowl 52, a flush tank 54, an upstanding bowl supply pipe 12 which also serves as an overflow preventor, and a water feed pipe 56. Toilet 50 further includes a ball-cock assembly 60 and associated float ball 62, a flush tank fill tube 64, and a bowl fill tube 66. Bowl fill or filler tube 66 is alternatively referred to as a bowl refill tube. The bowl refill tube is connected to receive bowl makeup water from water inlet tube 56 through ball-cock assembly 60 and to emit a jet of bowl makeup water into bowl supply pipe 12. Bowl refill tube 66 is retained and guided in some types of toilets by a fill tube aperture 35 as described above with reference to FIG. 5. Bowl supply pipe 12 is in fluid communication with toilet bowl 52 so that the jet of bowl makeup water emitted by filler tube 66 fills toilet bowl 52 after flushing. Toilet 50 also includes a flush valve 68 which opens to allow flush water from flush tank 54 to flush bowl 52. Bowl supply pipe 12 bypasses flush valve 68 allowing the bowl make-up or refill water to go directly to bowl 52.

Operational steps in accordance with the invention include filling supplying, or otherwise putting liquid conditioner into container reservoir 18. The supplying of liquid conditioner to reservoir 18 can be accomplished before or after installation within toilet 50. The novel methods also include placing, installing or mounting water conditioner dispensing apparatus 10 or 49 upon toilet 50. This mounting is preferably done upon bowl supply pipe 12. Installation includes placing conditioner container 16 adjacent bowl supply pipe 12. More specifically, installing the apparatus includes clipping and/or hooking conditioner container 16 upon bowl supply pipe 12 or otherwise supporting conditioner container 16, such as at the upper end of bowl supply pipe 12.

Further steps in accordance with the invention include positioning wick 36 to extend from container reservoir 18 into bowl supply pipe 12. More specifically, the inventive steps include immersing inner portion 38 of wick 36 in the liquid conditioner within the conditioner container and positioning outer portion 39 of wick 36 in the emitted jet of bowl makeup water from filler tube 66 so that liquid conditioner is dispensed only into the toilet bowl. Some installations will require aligning filler tube 66 so that its jet of bowl makeup water jets and impinges directly onto or against outer portion 39 of wick 36. Similar steps are performed in the installation shown by FIG. 5. In addition, however, the arrangement of FIG. 5 requires separating the legs of forked wick 37 and arranging them to extend downward around opposite sides of cross-piece 33.

Additional steps in accordance with the invention include wicking liquid conditioner from container reservoir 18 to bowl supply pipe 12. A dispensing cycle is initiated by flushing toilet 50. Further steps include jetting bowl makeup water from filler tube 66 onto wick 36 or 37. As a result of the bowl makeup water contacting wick 36 or 37, liquid conditioner is transferred from the wick into the flow of bowl makeup water carried by the bowl supply pipe 12. Liquid conditioner is thus dispensed into the bowl makeup water and into the toilet bowl. The preferred methods and apparatus result in selective treatment or conditioning of only the bowl makeup water. The flush water, stored by flush tank 54, is not treated.

The apparatus described above provides a number of desirable attributes in a single embodiment. Advantages of the preferred embodiment include reliability, absence of moving or sealing parts, general simplicity, and low cost. The cost of producing the container, support feature, and wick is substantially less in comparison to other types of prior art devices. The simplicity also results in a degree of reliability which has been difficult to obtain with liquid conditioner dispensers.

Installation of the apparatus is simple and convenient, since it includes a mounting clip for attaching the apparatus to existing components of a toilet. Once installed, the device works without any moving parts to automatically dispense a controlled amount of liquid conditioner during every flush cycle. Control is provided by the fluid capacity of the outer portion 39 of wick 36 or 37 and the rate of capillary transfer possible for a given size and type of wick. Furthermore, liquid conditioner is delivered only to the toilet bowl, through the toilet's overflow pipe, to avoid wasting conditioner in flush water. Conditioner is dispensed only during refill cycles-not between flushes. The apparatus uses liquid conditioner rather than solid or granular materials to further reduce expense and simplify operation and refilling. Liquid conditioners are also of greater miscibility and can be more effective for germicidal, coloring or deodorant purposes.

The apparatus can be reused indefinitely by repeatedly refilling the conditioner container reservoir with liquid conditioner. The apparatus can be refilled in place or removed during refilling. Refilling is more convenient than replacement or refilling of prior art devices. No replacement is normally necessary, although replacement is also convenient should it ever be required.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

We claim:

1. A water conditioner dispensing apparatus for use with a toilet having a bowl, a bowl supply pipe, and a filler tube which emits a jet of bowl makeup water into the bowl supply pipe to fill the bowl after flushing; to selectively treat or condition only the bowl makeup water; said apparatus comprising:

a conditioner container having a reservoir for holding liquid conditioner;

a wick which extends from within the container reservoir to an exterior of the container reservoir for placement in the supply pipe to be impinged by the jet of bowl makeup water so that liquid conditioner is dispensed only into the toilet bowl;

wherein the bowl supply pipe has an upper end, the water conditioner dispensing apparatus further comprising a vertical support for engaging the bowl supply pipe to vertically support the apparatus; said vertical support including a hook which is for hooking over the upper end of the bowl supply pipe.

2. A water conditioner dispensing apparatus in accordance with claim 1 and further comprising a wick aperture in said conditioner container through which said wick extends; said wick aperture being positioned near the top of the conditioner container.

3. A water conditioner dispensing apparatus accordance with claim 1 and further comprising a container lid.

4. A water conditioner dispensing apparatus in accordance with claim 1 wherein the wick has an exposed outer portion which extends downward from the container reservoir to allow a jet of bowl makeup water to impinge upon the exposed outer portion of the wick,

5. A water conditioner dispensing apparatus in accordance with claim 1 wherein the wick is split.

6. A water conditioner dispensing apparatus in accordance with claim 1 and further comprising liquid conditioner within the container reservoir.

7. A water conditioner dispensing apparatus for use with a toilet having a bowl, a bowl supply pipe, and a filler tube which emits a jet of bowl makeup water into the bowl supply pipe to fill the bowl after flushing; to selectively treat or condition only the bowl makeup water; said apparatus comprising:

a conditioner container having a top, bottom and sidewall defining a reservoir for holding a liquid conditioner;

a wick which extends from within the container reservoir to an exterior of the container reservoir for placement in the jet of bowl makeup water so that liquid conditioner is dispensed only into the toilet bowl;

wherein the bowl supply pipe has an upper end, the water conditioner dispensing apparatus further comprising:

a support clip mounted on said sidewall for engaging the bowl supply pipe to support the apparatus, the support clip including a pair of arms for partially encircling the bowl supply pipe;

the support clip further including a hook for hooking over said upper end of the bowl supply pipe.

8. A water conditioner dispensing apparatus for use with a toilet having a bowl, a bowl supply pipe, and a filler tube which emits a jet of bowl makeup water into the bowl supply pipe to fill the bowl after flushing; to selectively treat or condition only the bowl makeup water; said apparatus comprising:

a conditioner container having a top, bottom and sidewall defining a reservoir for holding a liquid conditioner;

liquid conditioner within the conditioner container;

a container mount attached to the sidewall of the conditioner container and adapted to be secured to the bowl supply pipe of a toilet; said container mount further including a hook for hooking over an upper end of the bowl supply pipe;

a wick having an inner portion which is partially immersed in the liquid conditioner within the conditioner container, the wick having an outer exposed portion which extends outside of the conditioner container for placement in the supply pipe to be impinged by the jet of bowl makeup water so that liquid conditioner is dispensed only into the toilet bowl.

9. A water conditioner dispensing apparatus in accordance with claim 8 and further comprising a wick aperture in said conditioner container through which said wick extends said wick aperture being positioned near the top of the conditioner container.

10. A water conditioner dispensing apparatus in accordance with claim 8 herein the container mount includes a pair of arms for partially encircling the bowl supply pipe.

11. A water conditioner dispensing apparatus in accordance with claim 8 and further comprising a container lid.

12. A water conditioner dispensing apparatus in accordance with claim 8 wherein the wick is split.

13. A water conditioner dispensing apparatus to selectively treat or condition only bowl makeup water used to fill the bowl of a toilet, the apparatus comprising:

a toilet bowl;

a bowl supply pipe;

a filler tube which emits a jet of bowl makeup water into the bowl supply pipe to fill the bowl after flushing;

a conditioner container having a reservoir for holding liquid conditioner; a container mount mounted to said conditioner container, said container mount further including a hook for hooking over an upper end of the bowl supply pipe;

an exposed wick which extends from the container reservoir into the bowl supply pipe;

the filler tube being oriented to project the jet of bowl makeup water onto the exposed wick to dispense liquid conditioner only into the toilet bowl.

14. A water conditioner dispensing apparatus in accordance with claim 13 and further comprising a wick aperture in said conditioner container through which said wick extends; said wick aperture being positioned near the top of the conditioner container.

15. A water conditioner dispensing apparatus in accordance with claim 13 and further comprising a support clip for engaging the bowl supply pipe support the apparatus, the support clip including a pair of arms for partially encircling the bowl supply pipe.

16. A water conditioner dispensing apparatus in accordance with claim 13 and further comprising a container lid.

17. A water conditioner dispensing apparatus in accordance with claim 13 wherein the wick is split.

18. A method of selectively dispensing water conditioner into a bowl of a toilet to treat or condition only the bowl makeup water used to fill the toilet bowl; said toilet including a bowl, a bowl supply pipe, and a filler tube; said method comprising:

placing a conditioner container adjacent the toilet bowl supply pipe, the conditioner container having a reservoir for holding liquid conditioner;

supplying liquid conditioner within said container reservoir;

positioning a wick to extend from the container reservoir and into said bowl supply pipe; said wick being positioned so that an exposed outer portion of the wick extends within the bowl supply pipe;

wicking liquid conditioner from the container reservoir to said bowl supply pipe;

jetting bowl makeup water directly onto said exposed outer portion of the wick which is positioned within the bowl supply pipe selectively dispense liquid conditioner into the bowl makeup water.

19. A method in accordance with claim 18 and further comprising immersing an inner portion of the wick in the liquid conditioner within the conditioner container.

20. A method in accordance with claim 18 and further comprising supporting the conditioner container on the bowl supply pipe.

21. A method in accordance with claim 18 and further comprising refilling the conditioner container reservoir with liquid conditioner.

* * * * *